US008228186B2

(12) United States Patent
Tryggö

(10) Patent No.: US 8,228,186 B2
(45) Date of Patent: Jul. 24, 2012

(54) LOCKING DEVICE, METHOD AND SYSTEM TO DETERMINE THE RELATIVE POSITION OF AN EDGE-LOCK TO A CONTAINER OR OF A GROUP OF CONTAINER EDGE-LOCKS IN RELATION TO OTHER CONTAINER LOCS

(75) Inventor: Dag Tryggö, Trollhättan (SE)

(73) Assignee: Loxysystem AB, Trollhattan (SE)

( * ) Notice: Subject to any disclaimer, the term of this patent is extended or adjusted under 35 U.S.C. 154(b) by 418 days.

(21) Appl. No.: 12/663,279

(22) PCT Filed: Jun. 11, 2008

(86) PCT No.: PCT/SE2008/050703
§ 371 (c)(1),
(2), (4) Date: Dec. 5, 2009

(87) PCT Pub. No.: WO2008/153495
PCT Pub. Date: Dec. 18, 2008

(65) Prior Publication Data

US 2010/0171597 A1 Jul. 8, 2010

(30) Foreign Application Priority Data

Jun. 12, 2007 (SE) ..... 0701426

(51) Int. Cl.
*G08B 1/08* (2006.01)

(52) U.S. Cl. ..... 340/539.1; 340/539.13; 220/1.5; 220/1.6; 220/315; 220/324; 70/58; 70/63; 410/77; 700/213

(58) Field of Classification Search ..... 220/1.5–1.6, 220/23.2, 23.4, 23.6, 200, 324, 315; 70/58, 70/63, 263–264; 410/52–95; 700/213–244; 340/686.1, 686.6, 539.1–539.32, 10.1–10.6
See application file for complete search history.

(56) References Cited

U.S. PATENT DOCUMENTS 7,002,472 B2 * 2/2006 Stratmoen et al. ..... 340/539.26
7,019,640 B2 * 3/2006 Canich et al. ..... 340/531
(Continued)

FOREIGN PATENT DOCUMENTS

SE 527608 C2 4/2006
(Continued)

OTHER PUBLICATIONS

Swedish Patent Office, Int'l Search Report in PCT/SE2008/050703, Sep. 8, 2008.

*Primary Examiner* — Daniel Wu
*Assistant Examiner* — Ryan Sherwin
(74) *Attorney, Agent, or Firm* — Potomac Patent Group PLLC

(57) ABSTRACT

The invention relates to a method to determine the relative position of a container corner lock and/or a group of container corner locks in relation to other container corner locks. The method comprises the steps of: requesting information regarding identification from those locks (1) that are within a certain area; transferring said information to each lock (1) within said area; storing, in each lock (1) within said area, said requested information from other locks within the area; determining, based on said stored information, the relative position of the lock and/or of the group of locks. The invention also relates to a system and a container corner lock.

16 Claims, 5 Drawing Sheets

U.S. PATENT DOCUMENTS

| | | | | |
|---|---|---|---|---|
| 7,216,806 | B2 * | 5/2007 | Kurita et al. | 235/385 |
| 7,323,981 | B2 * | 1/2008 | Peel et al. | 340/539.13 |
| 7,475,814 | B2 * | 1/2009 | Wingo et al. | 235/384 |
| 7,522,043 | B2 * | 4/2009 | English et al. | 340/545.6 |
| 7,922,085 | B2 * | 4/2011 | Thomas et al. | 235/384 |
| 2001/0035410 | A1 * | 11/2001 | Taube et al. | 220/1.5 |
| 2006/0220829 | A1 * | 10/2006 | Johnson | 340/505 |
| 2008/0020724 | A1 * | 1/2008 | Orrell | 455/187.1 |

FOREIGN PATENT DOCUMENTS

| | | | |
|---|---|---|---|
| SE | 527609 | C2 | 4/2006 |
| WO | 2006/025790 | A1 | 3/2006 |

* cited by examiner

LOCKING DEVICE, METHOD AND SYSTEM TO DETERMINE THE RELATIVE POSITION OF AN EDGE-LOCK TO A CONTAINER OR OF A GROUP OF CONTAINER EDGE-LOCKS IN RELATION TO OTHER CONTAINER LOCS

TECHNICAL FIELD

The present invention relates to a method to determine the relative position of a container corner lock and/or a group of container corner locks in relation to other container corner locks. The invention also relates to a system for implementation of the method as well as a container corner lock.

BACKGROUND

Today, containers are used for transporting load goods everywhere in the entire world. When containers should be conveyed to other continents, this preferably takes place by the containers being loaded on vessels for further transportation to the place of destination. In order for the transportation via vessel should work in safe way, it is required among other things that all containers on board have to be transportation-locked by means of some type of locking device. Today, four container locks are placed in each corner/bottom of a container. Each lock then locks into either a subjacent container alternatively the vessel deck (if the container is farthest down in a pile). Today, up to seven (7) containers are piled on each other in transportation via vessel.

There exists today a number of different types of locks on the freight market. Certain types of container locks comprise an automatic, mechanical locking procedure. A problem in this connection is that a visual inspection has to take place manually to guarantee that the locks have locked in intended manner. However, to unlock a container lock using today's solutions still has to take place manually. This operation takes place by staff walking around with long rods to reach up to locks on different levels, alternatively is hoisted up by means of a particular crane cab to unlock the locks by hand.

A problem of using wirelessly controlled container locks to decrease the manual work is that it is not desired to unlock all locks that are within radio range, but only those locking the container or containers to be lifted. It means that the system somehow has to possess knowledge about which container locks that are present on the respective container. See, e.g., WO2006/025790 A1, which shows remote-controlled container corner locks, where each lock that in connection with the lock being connected to a certain container is programmed with a number specific for the same container. These numbers are then stored in a database. Thereby, remote control is enabled of the locking and unlocking function by sending commands to locks that possess these preprogrammed numbers. However, to be able to remote control the locks, knowledge is required about these preprogrammed numbers.

By SE 527 608 C2, an additional method for remote control of container locks is previously known. In connection with locking, an automatic group allocation takes place, where the four locks locking a specific container are allocated a unique group identification number. Remote controlled unlocking of the locks then takes place by an external unit sending out a request regarding which locks that are in the vicinity. Each lock sensing the request sends out its group identification number as answer, all answers being processed and it being established which locks are locking the container in question. Even if this method works well, it is desirable to additionally improve it and provide a way to determine the relative position of each container corner lock and/or groups of container corner locks.

SUMMARY OF THE INVENTION

Thus, an object of the present invention is to provide a method to determine the relative position of a container corner lock and/or a group of container corner locks in relation to other container corner locks. All container corner locks locking the same container have been allocated an identification and belong to the same lock group.

Said object is attained by the invention by means of method that is initiated by the fact that information regarding identification, e.g., identification number, from those locks that are within a certain area is requested. From the locks, identification number information is then transferred to each lock within said area. Each lock stores the information regarding all locks within the area to, by means of this information, determine the relative position of the lock and/or of the group of locks.

The method makes it possible to determine the relative position of each container corner lock and/or groups of container corner locks by information from other locks that are in the vicinity is collected and stored in each lock. Thereby, it becomes easier to upon unloading of a container distinguish which locks are locking the container in question. It also enables an improved overview of those containers that are in the area, something which can be used upon establishment of a general picture of the area.

Said object is attained by the invention also by means of a system comprising a number of locks arranged to be connected to a container and to work as connecting elements between two containers to determine the relative position of a container corner lock and/or a group of container corner locks in relation to other container corner locks. The locks comprise means to request information regarding identification from those locks that are within a certain area, means to transfer the information to each lock that is within the area as well as means to store the information in each lock. The system also comprises means, either arranged in the lock or in an external unit, to determine, based on the stored information, the relative position of the lock and/or of the group of locks.

Said object is attained by the invention also by means of a container corner lock arranged to be connected to a container and to work as connecting element between two containers. The lock comprises means to request information regarding identification from those locks that are within a certain area, means to transfer the information to each lock that is within the area as well as means to store the information in the lock.

Such a formed lock makes it simple to determine relative location of container corner locks by the fact each lock included in the system itself collects and stores different types of measuring data about the other locks that are in the vicinity of the lock.

DESCRIPTION OF FIGURES

The invention will in the following be described in a non-limiting way and for illustrative reasons, reference being made to the accompanying figures in which.

DETAILED DESCRIPTION OF THE INVENTION

The present invention provides a method to determine the relative position of a container corner lock and/or a group of container corner locks in relation to other container corner locks.

Figure 1:
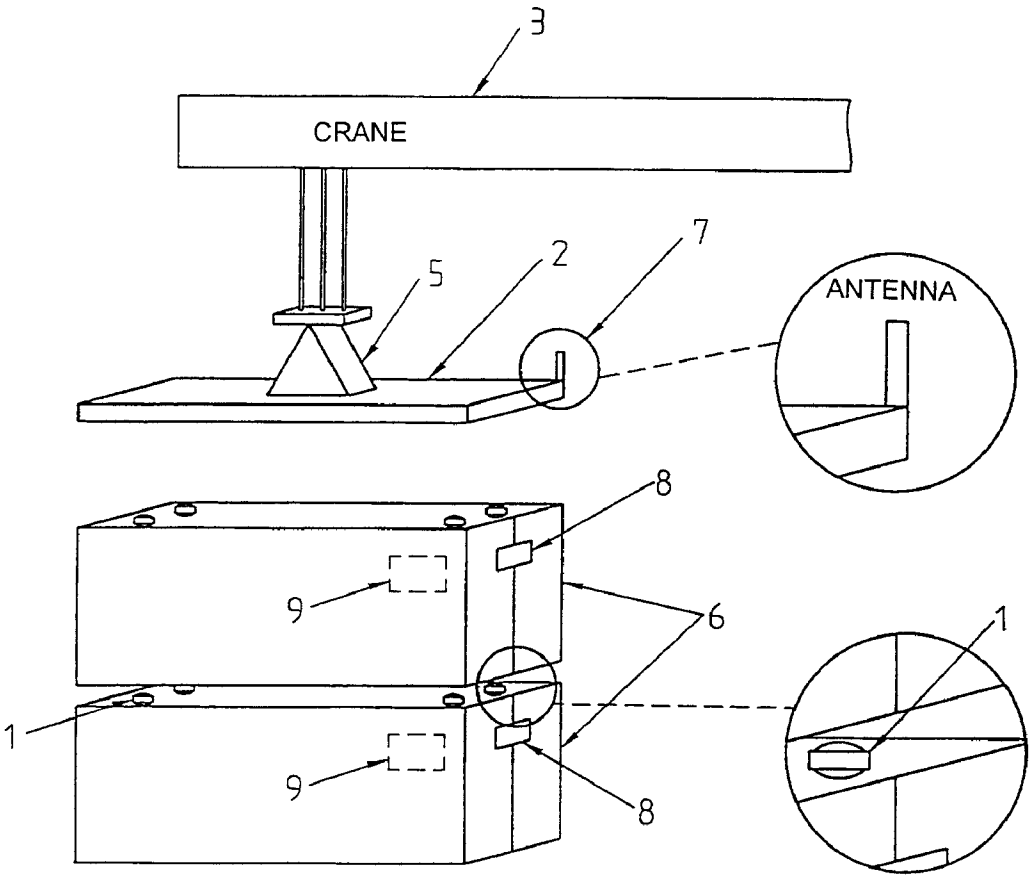
FIG. 1 shows a crane equipped with a yoke for lifting containers.

FIG. 1 shows a crane 3 equipped with a yoke 5 for lifting containers 6. On the yoke of the crane, there are units 2, 7 mounted for communicating with container corner locks 1, which are under the yoke. From a central processing unit 2 or another suitable external unit, it is possible to send commands to and receive answers from those container corner locks 1, which are in a pile or stack of containers under the yoke 5 to a crane 3. The unit 2 is equipped with transmitter and receiver functionality and can communicate with the different container locks to guide which locks that should be locked and which that should be unlocked to be able to load or unload one or more containers. From a central processing unit, it is possible to send commands to and receive answers from those container locks that are in a pile or stack of containers under the crane yoke.

Preferably, the unit arranged is externally from the container and is preferably arranged on the yoke of a crane or it consists of a mobile unit for handling by staff. Preferably, the unit is equipped with the communication equipment and functionality that is required to talk with different types of extra equipment such as GPS, seal or other electronic information sources applied to a container.

Figure 2:
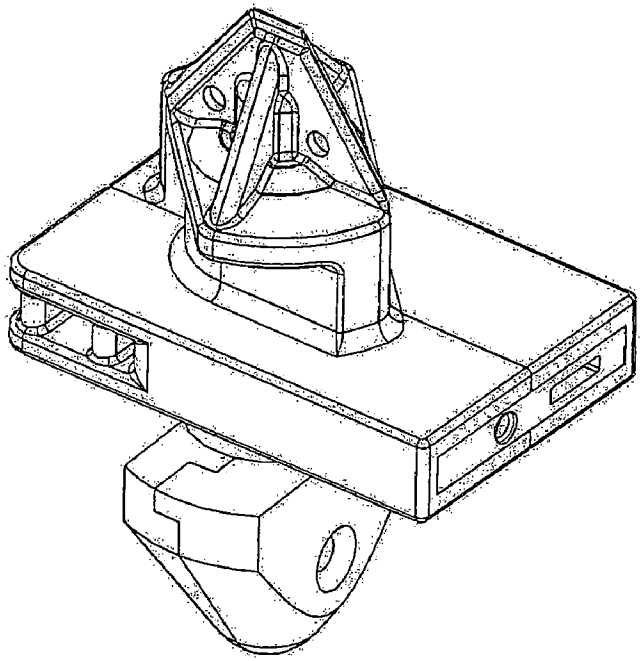
FIG. 2 shows an example of a design of a device according to the invention, a so-called container corner lock.

FIG. 2 shows an example of a lock 1 arranged to be connected to a container and to work as connecting element between two containers, henceforth denominated container corner locks.

Figure 3:
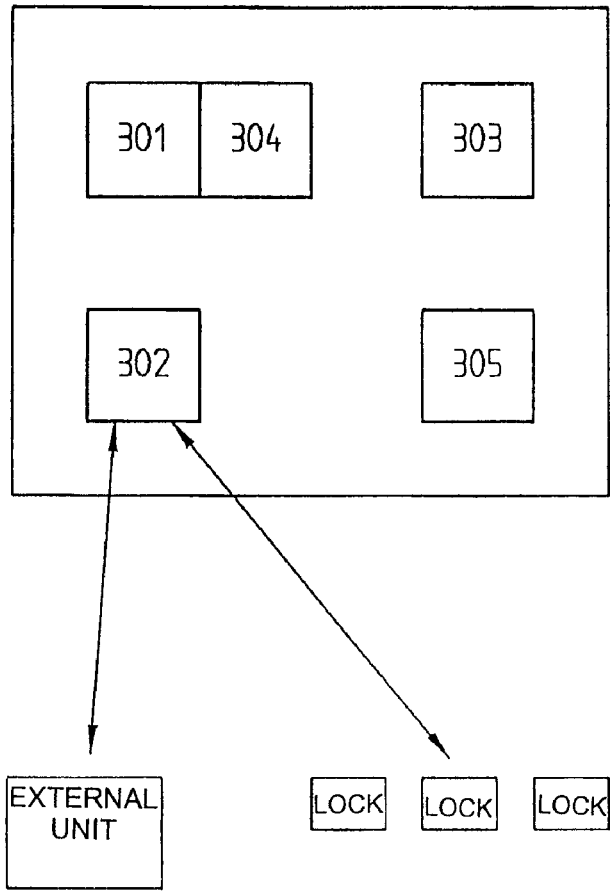
FIG. 3 shows a very schematic overview of the interior of a container corner lock.

FIG. 3 shows highly schematically how a container corner lock 1 internally is equipped with electronic functions for detecting and storing information as well as communicating with another units. Therefore, inside a container corner lock 1 according to the invention, there is room for one or more units 301 arranged to fetch information from locks in the environment of the container. One or more memories or storage units 303 are arranged in the locks for storing the fetched information. The lock is also provided with transmitter and receiver functionality 302 to be able to transfer information that is stored in the lock to an external unit or other locks as well as to communicate with the external unit and other locks. Adjacent to the unit 301, there is a control unit 304, which can keep track on when it is time to request information from other locks 301 and which information that should be stored in the storage unit 303. The control unit 304 can control and regulate information retrieval and storage and may be provided with a calculation unit. Preferably the lock is also provided with a unit 305, which is arranged to detect different properties of received information. For instance, the unit 305 may detect by which signal strength and/or quality that information from different locks is received, at which instant of time the information was received or how long time the transfer took as well as information regarding the size of the container that the lock, from which the information comes, locks. The control unit 304 can thereby, based on this information and by means of different algorithms, make a good, relative position determination of the lock in relation to those locks that are in the surroundings. Also the known loading places of a vessel may be used in the position determination as well as the well-known fact that the containers generally stand in straight rows next to each other and in columns on top of each other. In addition, the lock according to the present invention is preferably provided with a motor to enable locking and unlocking, respectively, of the lock, power supply means as well as possible other electronics. Means for power supply may, for instance, be a disposable battery or a rechargeable battery or some other form of source of power.

Figure 4:
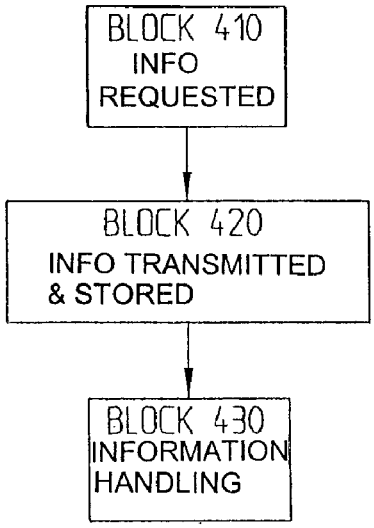
FIG. 4 shows a flow chart over a method according to the invention for providing information about the environment of a container.
Figure 5:
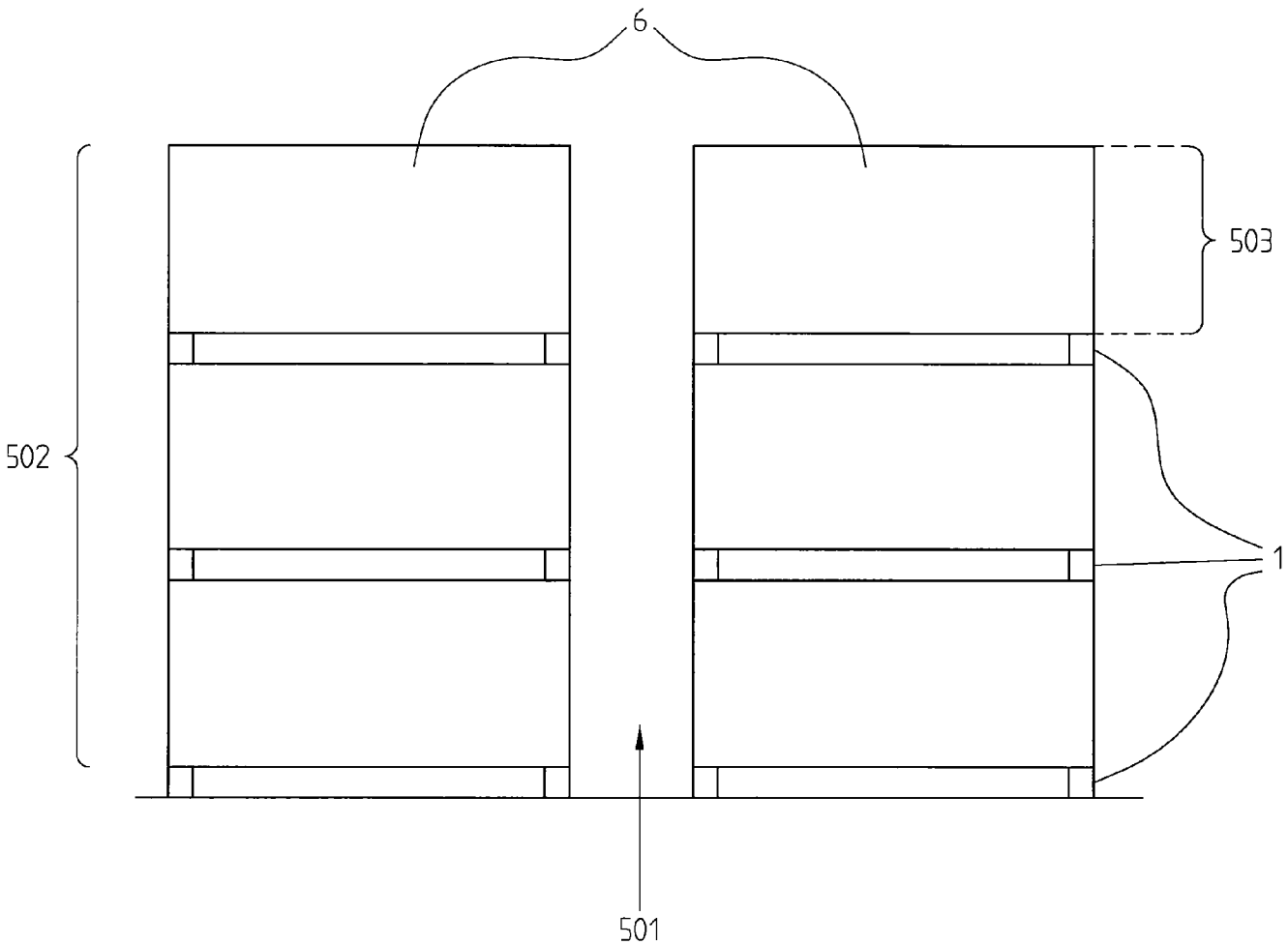
FIG. 5 shows a very schematic picture over containers arranged in stacks.

FIG. 4 shows a flow chart over a method according to the invention to determine the relative position of a container corner lock and/or a group of container corner locks in relation to other container corner locks. Each lock has a unique identity number and the locks locking a container are all included in a group having a unique group number. The four locks locking a container may, for example, all be provided with the same ID number and group number, e.g., A. Each lock may also be provided with an individual number for each lock in the form of A1, A2, A3 and A4 and with a common group number, e.g., A. The method is initiated, according to block 410, by the fact that information regarding identification/identification number from those locks that are within a certain area is requested. The request of information may take place by the proper locks or by an external unit arranged separately from the lock. Preferably, a central processing unit or an external unit sends out request to all locks in the nearness thereof of sending information about how the local environment of the respective lock looks like. To improve the position determination, the information is not limited to only comprising identification number, but in order to measure up the local environment and create a picture of the environment thereof, the locks may use a combination of a plurality of different information. When containers are piled on a goods vehicle, the containers are not placed entirely symmetrical, but openings, so-called "corridors" 501 are created between rows of containers—see FIG. 5. The communication between the locks on each side of a corridor will be considerably better than between locks that are on different sides of containers in a bay and which face different corridors. A bay consists of containers standing beside each other in breadth of the vessel. Upon comparison of two containers in different "bays", those locks that are farthest from each other will end up at a distance of 2×40 ft plus the width of the corridor from each other, which is easy to measure, especially by means of antennas on both short sides of a lift yoke. This difference of strength, the locks can utilize. Two locks belonging to different groups often come very close to each other, distance of approximately 20-30 cm, when they are on adjacent containers in the same passage 501 ("bay") and layer 503 ("layer"). In particular when the containers have the same height, standard or "high cube". The sizes and geometry of the containers can be used to correct a calculated geometrical picture. Containers are always rectangular and exist only in a few lengths, for instance 20 ft and 40 ft. If the group of locks is aware about the size of the container they lock, this information can be used to calculate the position of the locks and then mediate this information to other container locks. If a vessel possesses known loading places, this may be used upon the position determination. It is also possible to use the fact that the containers stand in straight rows and columns on top of each other in layers to facilitate the operation of calculating the position. All locks in a certain group will always be positioned in the same plane and on the same layer of containers. Containers are usually loaded by means of one or a few cranes simultaneously. This means that the time when a container was loaded differs between each container. If the locks in a group stores the information when the container was loaded, also that information is possible to use as support to calculate position. In block 420, then transfer of the information between the involved locks takes place. To send information between a central processing unit and container lock, as well as between container locks takes differently long time depending on the distance between the communicating parties, i.e., the transit time varies with the distance. If the container locks calculate the time it takes to transfer the information, also this information is possible to use upon calculation of position. Information that has reached the different locks is then stored in a storage unit in the locks. Information may be limited to selected or relevant information and may comprise, e.g., identification and signal strength and/or signal quality etc. Thus, each lock will possess relevant information regarding locks (preferably each lock) that are within the area. The size of the area may vary, but it is preferably signals from other locks within a distance between one and two container widths that are stored. The area is primarily not determined by a predefined geometric area but is determined by the range of the signal. Only locks the signals of which exceed a certain limit may be selected to be included in the process. Thus, if it is preferred to obtain information from a large number of locks, the limit is set low. As an alternative, it is conceivable to vary the strength of the signal transmitted from the locks to thereby make the area greater or smaller. After transfer of the respective lock's own measurement results regarding other locks, then in block 430 the treatment of all stored information takes place. By means of the stored information, a number of data is given by means of which the position of the locks can be determined with great accuracy. The greater the quantity of data that is stored, the more the accuracy increases, but it also imposes higher requirements of the algorithms calculating the positions. The calculations or the process of the information may take place in the external unit but it may also take place in the locks. By means of the relative positions, it becomes simple to establish that correct lock is unlocked when a container should be lifted. The determination of the positions also enables that it is possible to draw a general picture over how the different containers are arranged on, for example, a vessel. This general picture may, for instance, be stored in a computer or the like on the vessel or in another external unit. Since the locks on request send out information about the environment thereof, the relative positions can on desired occasions be corrected, which entails a dynamic picture that can be brought to be updated automatically. The communication between the locks and thereby the object of measurement of signal strength etc., may consist of, e.g., radio and/or sound signals.

Figure 6:
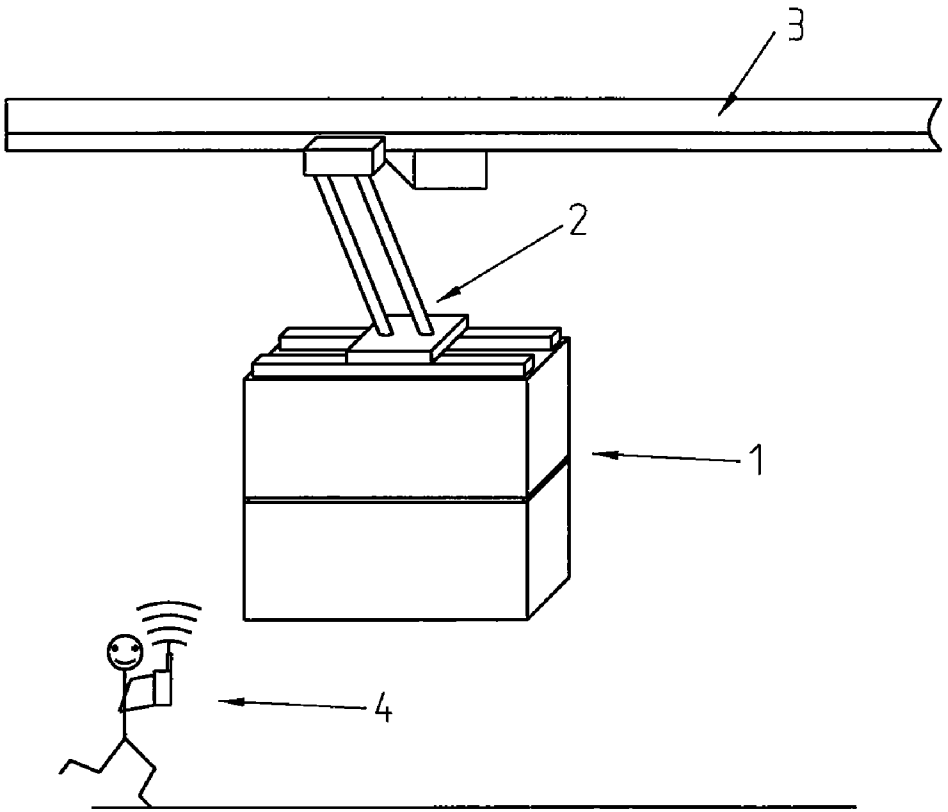
FIG. 6 shows a schematic picture over a preferred method where two containers are lifted simultaneously.

Preferably, the position determination takes place in connection with unloading according to the method shown in FIG. 6. A unit 2 on a crane 3 communicates with container corner locks 1 by means of communication equipment 2 fastened on the yoke or on the crane 3. This method may be used when equipment 2 to telecommunicate with the radio units inside the container corner locks 1 is arranged on or adjacent to the crane. This unit/equipment 2 may for instance be arranged on the yoke 5 of the crane 3 or on some other part of the crane. By arranging the unit 2 in direct connection to the crane, it is guaranteed that the unit comes sufficiently near the container corner locks to enable communication between the unit and the locks. This eliminates the need of physical manpower in the load zones during the unloading occasions and means transfer of the detected information entirely without intervention of staff. Upon unloading of two or more containers simultaneously, a so-called multiple lift, the transfer from the locks to the external unit may take place generally simultaneously or with a very short interval between the transfers. Either information is stored after transfer in the external communication unit 2 for processing of the information and/or for forwarding to a central computer system, or the information is transferred directly to a central computer system for storage and/or processing.

According to an alternative method, a person may stand by the side of the container/containers and communicate with the container corner locks by means of a handheld communication equipment 4.

The way to communicate between a central processing unit 2, 4 and container corner locks 1 as well as between container corner locks and extra equipment may take place by means of different methods. The communication may, for instance, take place wirelessly by radio, optically, by sound including ultrasound or by mass waves/vibrations.

The nature and the function of the invention should have been clear of what has been said above and shown in the drawings. The invention is naturally not limited to the embodiments described above and shown in the accompanying drawings. Modifications are feasible, for example by usage of equivalent technique, without departing from the protection area of the invention, such as it is defined in the claims.

The invention claimed is:

1. A method of determining a relative position of a container corner lock or of a group of container corner locks in relation to other container corner locks, wherein container corner locks work as connecting elements between two containers, all container corner locks locking the same container have been allocated an identification and belong to the same group of container corner locks, comprising:

requesting information regarding identification from those container corner locks that are within a certain area;

transferring requested information to each container corner lock within the certain area;

storing, in each container corner lock within the certain area, requested information from other container corner locks within the area; and determining, based on the stored information, the relative position of the container corner lock or group of container corner locks.

2. The method of claim 1, wherein the requesting takes place from the respective container corner lock.

3. The method of claim 1, further comprising requesting identification information from at least one communication unit within the area, and storing the requested information in each container corner lock.

4. The method of claim 1, further comprising detecting and storing information regarding a signal strength or a quality by which the information was received.

5. The method of claim 4, wherein the relative position is determined based on only information the signal strength of which exceeds a certain value.

6. The method of claim 1, further comprising detecting and storing information regarding at least one of which time instant the information was transferred, which time instant the information was received, and how long time a transfer took.

7. The method of claim 1, further comprising transferring and storing information regarding a size of the container the respective container corner lock locks.

8. A system of determining a relative position of a container corner lock or of a group of container corner locks in relation to other container corner locks, comprising:

a plurality of container corner locks arranged to be connected to a container and to work as connecting elements between two containers, wherein each container corner lock within a certain area includes a device configured for requesting information regarding identification from other container corner locks that are within the certain area;

a device configured for transferring requested information to other container corner locks within the certain area;

a memory for storing the requested information from other container corner locks within the certain area; and a device configured to determine, based on stored information, the relative position of the container corner lock or of the group of container corner locks.

9. The system of claim 8, further comprising a memory configured to store information regarding at which time instant requested information was received.

10. The system of claim 8, further comprising a memory configured to store information regarding at least one of which time instant requested information was transferred, which time instant requested information was received, and how long time an information transfer took.

11. The system of claim 8, further comprising a memory configured to store information regarding a size of the container the respective container corner lock locks.

12. A container corner lock arranged to be connected to a container and to work as a connecting element between two containers, comprising: a device configured for requesting identification information from a container corner lock that is within a certain area; a device configured for transferring identification information to another container corner lock that is within the certain area; and a memory configured for storing requested information from another container corner lock within the certain area.

13. The container corner lock of claim 12, further comprising a device configured for determining, based on requested information, a relative position of the container corner lock or of a group of container corner locks.

14. The container corner lock of claim 12, further comprising a device configured for detecting and storing information regarding at least one of a signal strength and a quality by which requested information was received.

15. The container corner lock of claim 12, further comprising a device configured for detecting and storing information regarding at least one of which time instant information was transferred, which time instant information was received, and how long information transfer took.

16. The container corner lock of claim 12, further comprising a device configured for transferring and storing information regarding a size of the container the respective container corner lock locks.

* * * * *